US011002030B1

(12) United States Patent
De Jesus

(10) Patent No.: US 11,002,030 B1
(45) Date of Patent: May 11, 2021

(54) POOL LADDER WITH AUTOMATIC WASH-DOWN SYSTEM

(71) Applicant: Ryon De Jesus, Brentwood, NY (US)

(72) Inventor: Ryon De Jesus, Brentwood, NY (US)

( * ) Notice: Subject to any disclaimer, the term of this patent is extended or adjusted under 35 U.S.C. 154(b) by 170 days.

(21) Appl. No.: 16/293,872

(22) Filed: Mar. 6, 2019

(51) Int. Cl.

| | |
|---|---|
| ***E04H 4/14*** | (2006.01) |
| ***E06C 7/18*** | (2006.01) |
| ***E06C 1/26*** | (2006.01) |
| ***E06C 7/00*** | (2006.01) |
| ***B08B 3/02*** | (2006.01) |
| ***E04H 4/16*** | (2006.01) |
| *E06C 9/02* | (2006.01) |

(52) U.S. Cl.
CPC ..... *E04H 4/144* (2013.01); *B08B 3/02* (2013.01); *E04H 4/16* (2013.01); *E06C 1/26* (2013.01); *E06C 7/00* (2013.01); *E06C 7/183* (2013.01); *E06C 9/02* (2013.01)

(58) Field of Classification Search
CPC ... E04H 4/144; E04C 9/02; E06C 5/32; E06C 1/26; E06C 7/00; E06C 7/183; B04H 4/16
See application file for complete search history.

(56) References Cited

U.S. PATENT DOCUMENTS 3,925,830 A * 12/1975 Delaney ..... A61H 35/006 4/615
D265,251 S * 6/1982 Darby ..... D25/63
4,749,130 A * 6/1988 Utzinger ..... B01D 11/0449 239/543
4,961,535 A * 10/1990 Skibik ..... A47C 1/14 239/289
5,056,167 A * 10/1991 Cholley ..... E04H 4/1209 4/492
5,333,323 A * 8/1994 Aymes ..... E04H 4/144 182/93
5,367,720 A * 11/1994 Stephens ..... A47K 3/022 4/494
6,000,494 A * 12/1999 Wilson ..... E04H 4/144 182/106
6,202,787 B1 * 3/2001 Kessler ..... E04H 4/144 182/106
D449,895 S * 10/2001 Wilson ..... D25/2
6,367,584 B1 * 4/2002 Edwards ..... E04H 4/144 182/129
6,668,842 B1 * 12/2003 Wilke ..... A47L 23/02 134/113
8,127,891 B1 * 3/2012 Gudinas, Jr. ..... E04H 4/144 182/129
9,388,594 B2 * 7/2016 Erlich ..... E04H 4/1263
(Continued)

*Primary Examiner* — Colleen M Chavchavadze
*Assistant Examiner* — Candace L Bradford
(74) *Attorney, Agent, or Firm* — Sanchelima & Associates, P.A.; Christian Sanchelima; Alexander Rodriguez

(57) ABSTRACT

The present invention provides a pool ladder with an automatic wash-down system for cleaning a person's feet before entering a swimming pool. The pool ladder includes a staircase to allow a person to climb into the swimming pool. The wash-down system includes nozzles positioned in the staircase to direct water spray towards the person's feet. The wash-down system further includes sensors to detect the presence of the person on the staircase and a controller to regulate the flow of water to the nozzles, based on signals from the nozzles, for automatic washing of the person's feet when the person is standing on one of the steps of the staircase.

14 Claims, 4 Drawing Sheets

(56) References Cited

U.S. PATENT DOCUMENTS

| | | | | |
|---|---|---|---|---|
| 9,938,766 | B2 * | 4/2018 | Cordani | A62B 5/00 |
| 2006/0236447 | A1 * | 10/2006 | St-Hilaire | E04H 4/144<br>4/506 |
| 2014/0124294 | A1 * | 5/2014 | Daizadeh | E06C 1/26<br>182/106 |
| 2014/0209333 | A1 * | 7/2014 | Cordani | E06C 7/00<br>169/70 |

* cited by examiner

POOL LADDER WITH AUTOMATIC WASH-DOWN SYSTEM

BACKGROUND OF THE INVENTION

1. Field of the Invention

The present disclosure generally relates to a pool ladder which allows a person to climb and enter into an aboveground swimming pool; and more particularly to a pool ladder with an automatic wash-down system to clean the person's feet before entering the swimming pool.

2. Description of the Related Art

Most of the times when people dive into a swimming pool, they may bring along dirt and other debris which may have been stuck on their feet and lower portions of legs. When they enter the pool, such picked-up dirt and debris is washed by the pool water and get deposited therein. This may result in dirty swimming pools, and sometimes may even lead to clogged swimming pool filters. This problem may particularly be more significant when the swimming pool has been surrounded by a lawn or any area with grass or some kind of dirt or soil; as the people may be engaged in walking on the grass or playing in the lawn before entering the pool which may lead to higher probability of dirt or debris getting stuck on their feet.

In efforts to keep swimming pools clean, sometimes the owners may provide a hose or the like near the point of entry into the swimming pool, so that the swimmers may first wash their feet before entering into the pool. Some owners may even install showers or some form of basins to be used by people for washing their feet before entering the swimming pool. However, most of the people chose not to use such facilities, sometimes due to excitement to jump straight into the pool without waiting or may be even due to laziness to use such mechanical facilities, or for some other reasons. Furthermore, such methods of providing hose, or using shower or basins, may require separate space to install and may also lead to use of large amount of water, which is economically and environmentally not suitable.

Applicant believes that a related reference corresponds to U.S. Pat. No. 6,367,584 B1 (hereinafter referred to as '584 patent) which discloses a ladder for aboveground pools with incorporated foot rinsing system. The '584 patent provides that the ladder portion is comprised of a pair of elongated vertical spaced apart rails. The ladder portion includes a plurality of horizontal steps extending between the pair of rails in a spaced relationship. A water tank is secured to one of the pair of elongated vertical spaced apart rails of the ladder portion. The water tank has a hollow interior for holding a quantity of water therein. A plurality of water nozzles are secured within one of the pair of elongated vertical spaced apart rails of the ladder portion in a spaced relationship. The water nozzles are directed downwardly toward the horizontal steps of the ladder portion. The water nozzles are connected with the hollow interior of the water tank for receiving water therefrom.

Although the disclosed ladder of the '584 patent provides automatic means for cleaning a person's feet climbing thereon, but the disclosed device may not be able to thoroughly wash the person's feet entering into the pool due to the placement of the water nozzles. The ladder of '584 patent has water nozzles secured only along one of the pair of elongated vertical spaced apart rails of the ladder portion which limits the coverage area of the disclosed water nozzles, for example, in case of a person standing proximal to the opposite rail of the ladder portion to which the water nozzles are secured. Moreover, the secured water nozzles being located at a distance from middle of the steps where a person would be likely standing further limits the capability of the cleaning means of the disclosed ladder. Also, the disclosure does not provide any means to distinguish between scenarios when a person is climbing up to enter the swimming pool (when cleaning of feet is required) or when a person is climbing down to exit from the swimming pool (when cleaning of feet is not required), and may generate water sprays in both scenarios leading to wastage of water and inconvenience to the user. Furthermore, the '584 patent does not describe functioning of any means to independently control water nozzles for each step of the ladder portion, or how it may be achieved.

Other documents describing the closest subject matter provide for a number of more or less complicated features that fail to solve the problem in a convenient and efficient manner. None of these documents suggest the novel features of the present invention.

SUMMARY OF THE INVENTION

It is one of the main objectives of the present invention to provide a pool ladder with an automatic wash-down system for cleaning a person's feet before entering a swimming pool.

It is another objective of the present invention to provide the pool ladder in which the wash-down system has nozzles positioned to appropriately cover substantial area of a step of the pool ladder, especially middle thereof, for proper cleaning of the person's feet.

It is still another objective of the present invention to provide the pool ladder in which the wash-down system is configured to automatically turn on the flow of water for only the step onto which the person is standing, and later turn off when the person has moved therefrom.

It is yet another objective of the present invention to provide the pool ladder in which the wash-down system is configured to detect whether the person is climbing up to enter into the swimming pool or climbing down to exit from the swimming pool, so as to turn on the flow of water only in former scenario.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
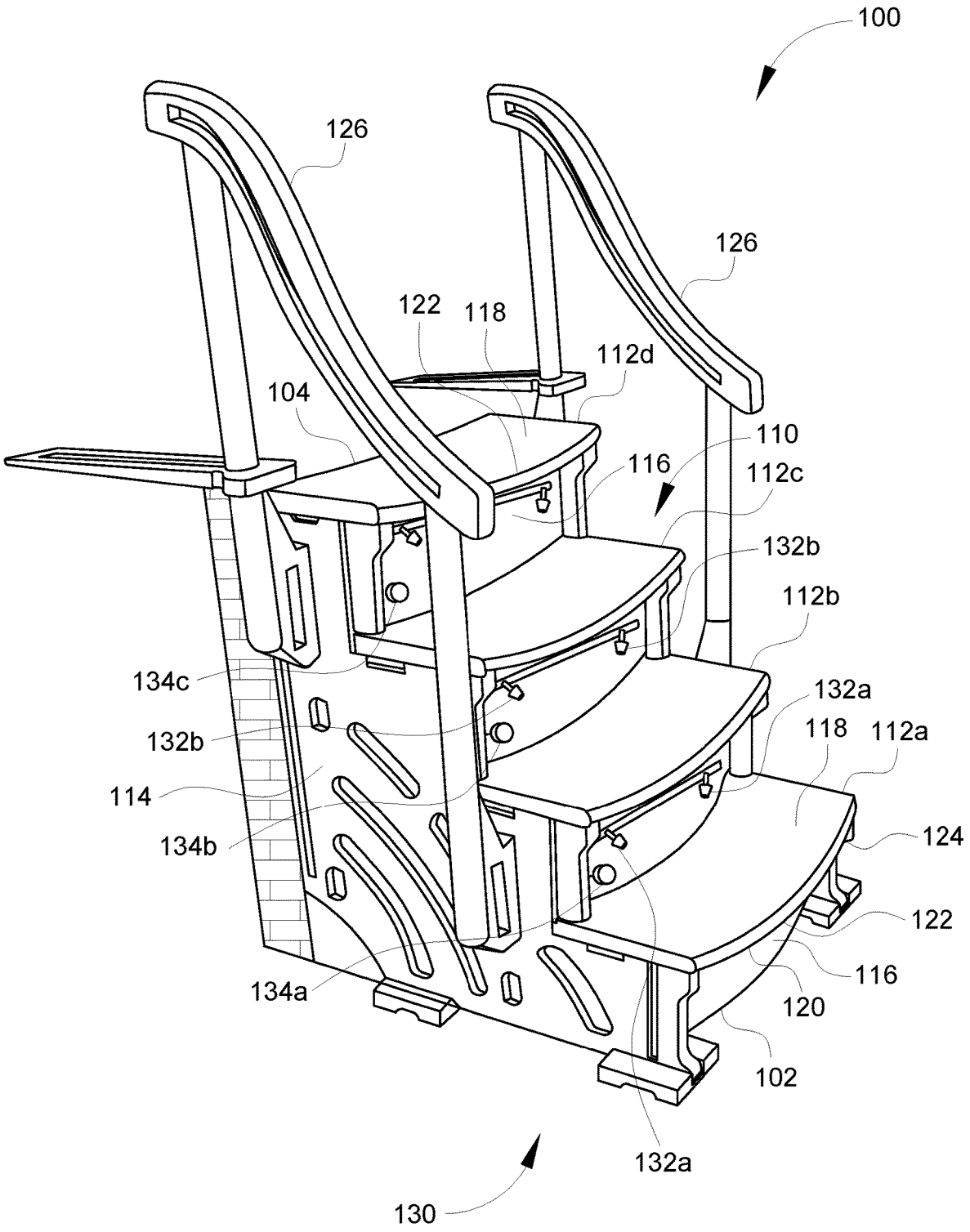
FIG. 1 illustrates a perspective view of a pool ladder with a wash-down system, in accordance with an embodiment of the present disclosure.

Referring to the drawings, FIG. 1 illustrates a pool ladder, generally indicated using the numeral 100. The pool ladder 100 of the present disclosure is particularly adapted to bridge an upstanding cylindrical platform of an above-ground swimming pool (not shown) in order for a person to climb to the platform to access and enter the swimming pool therefrom. Specifically, the pool ladder 100 may include a lower end portion 102 which is supported on the ground and an upper end portion 104 which is resting against the platform of the swimming pool. In some examples, the upper end portion 104 may, optionally, be secured to the platform using any suitable fastening means for properly securing the pool ladder 100 in place and thereby preventing an unwarranted movement thereof. It may be appreciated that the pool ladder 100 herein illustrated and described is not limited to this particular end use, and possesses general utility in other applications apart from this specific swimming pool environment.

The pool ladder 100 includes a plurality of molded plastic parts, certain of which are identical and assembled in mirror-image relationship to provide the completed pool ladder 100. At this point it will be noted that the mirror-image parts described hereafter are identical and will be designated by the same numbers even though they are assembled in mirror-image relationship, as will be apparent from the drawings. In this preferred embodiment, many of the various parts and components of the pool ladder 100 are shown and described as being hollow or tubular members, and these parts may be easily formed by blow molding a suitable plastic, such as polyethylene.

As illustrated in FIG. 1, the pool ladder 100 may structurally include a staircase 110 having a series of alternating horizontal steps (collectively referred by the numeral 112), and a pair of identical generally planar parallel vertical walls 114 defining the sides of the staircase 110 and interconnected by the series of the alternating steps 112. In the staircase 110, as illustrated in FIG. 1, the steps 112 are spaced apart and connected to each other by vertical risers 116 extending between two alternate steps 112 therein. In the exemplary illustration of FIG. 1, the staircase 110 has been shown to include four steps 112*a*, 112*b*, 112*c*, 112*d*, whereby the steps 112 are spaced closer together compared to typical three-step staircases to make it easier to climb the steps for entering and exiting the swimming pool, especially for seniors and kids. In some examples, the staircase 110 may be a modular assembly in which the steps 112, the vertical walls 114 and the risers 116 may be snapped together to easily fit with each other in order to complete the assembly thereof.

In the staircase 110, each of the steps 112 includes a top surface 118 and an opposing bottom surface 120. In some examples, each of the steps 112 preferably has some suitable non-slip treads or the like provided on the top surface 118 to avoid slipping of the person standing thereon. Further, as illustrated in FIG. 1, each of the steps 112 may have a front portion 122 with a curved profile which provides safe access for a person climbing thereon and further provides a person with extra space to sit and relax on the steps 112, if desired. Further, in one embodiment of the present disclosure, the front portion 122 may extend slightly outwards from the vertical risers 116 to define an extended space 124. The extended space 124 provides a suitable location to install required components underneath the bottom surface 120 of the steps 112 if desired, as will be discussed in later paragraphs.

In some examples, the pool ladder 100 includes a sloping handrail 126 provided with the staircase 110, and which may be grasped by a person to climb the staircase 110. As may be seen from FIG. 1, the handrail 126 may be disposed to extend parallel to the slope of the steps 112, as is typical for staircases. The handrail 126 may extend between the lower end portion 102 and the upper end portion 104 of the pool ladder 100. In some examples, the handrail 126 may extend along the entire length of the staircase 110, that is starting from the lower end portion 102 and terminating at the upper end portion 104; or alternatively may be limited to partial length of the staircase 110 (as illustrated in the drawings). In some examples, the handrail 126 may be provided with supports (not shown) which serve as handholds as a person walks up the steps or to otherwise pull oneself up. It may be understood that the staircase 110 may be provided with a plurality of recesses adapted to receive the end portions of the handrail 126 to secure the handrail 126 to the staircase 110, preventing chances of any unintended separation of the handrail 126 therefrom.

The present pool ladder 100 may be designed and dimensioned in consideration of the standards associated with the height of above-ground swimming pools or the like. The following dimensions and other dimensions contained herein, unless otherwise indicated, are provided for exemplary purposes only and not for purposes of limitation. In one example, the overall projection of the pool ladder 100 may be about 32 inches, the overall height may be about 47 inches (which could be increased by using for adjusting means), and the overall width may be about 38 inches. The average dimensions of each of the step 112 may be about 27 inches in width and 10 inches in depth, and the riser height may be about 11 inches. Further, the height of the handrail 126 (from ground level) may be about 45 inches. In some examples, the present pool ladder 100 may use two-tone warm grey and taupe color scheme, without any limitations.

In one embodiment, the staircase 110, including the steps 112 and the vertical walls 114, may be fabricated of molded high density polyethylene, polypropylene and/or conventional polymers. The all-plastic construction may help to protect the staircase 110 from corrosion when coming into contact with water, and further may not affect water chemistry in contact therewith. Further, this allows the ladder structure to be economically formed to a hollow or tubular shape by a well-known and economically viable blow molding technique, with structural flexure strength being reinforced by the inserts where necessary. Due to hollow structure of the pool ladder 100, in some cases, the member of the staircase 110 may be filled with sand, pea gravel or any other suitable material to provide internal rigidity to the ladder structure for withstanding at least the weight of person standing thereon to climb into the swimming pool.

Figure 2:
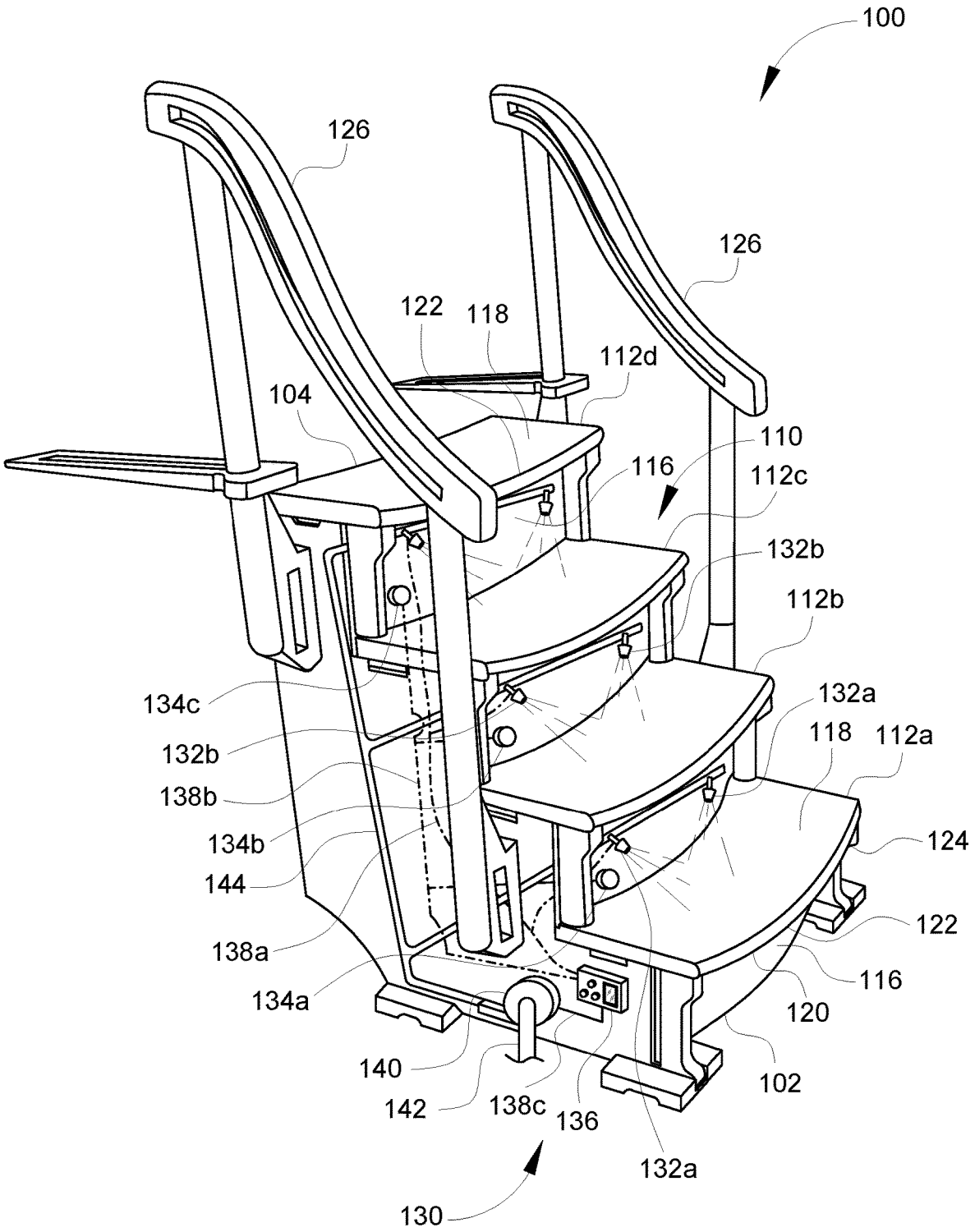
FIG. 2 illustrates a perspective view of the pool ladder of FIG. 1 with a portion thereof removed in order to show components inside therein, in accordance with an embodiment of the present disclosure.

FIG. 2 illustrates the pool ladder 100 with a section of the vertical wall 114 removed in order to show the components located inside the hollow structure of the pool ladder 100. With reference to FIGS. 1-2 and in accordance with embodiments of the present disclosure, the pool ladder 100 includes a wash-down system 130 for cleaning a person's feet climbing up the staircase 110, say for entering into a swimming pool. The wash-down system 130 of the present disclosure, generally, includes multiple nozzles 132 strategically placed on the staircase 110, one or more sensors 134 to detect the presence of a person in proximity thereto, and a controller 136 to control the flow of water through the nozzles 132 based on the signals from the sensors 134. In the present wash-down system 130, the controller 136 is disposed in signal communication with the sensors 134 to receive the signals indicating the presence of a person in proximity thereto and accordingly control the corresponding nozzles to generate the flow of water directed towards the step 112 associated therewith.

In particular, as illustrated in FIGS. 1-2, the nozzles 132 may be positioned around the extended surface 124, and specifically secured to the bottom surface 120 of each step 112 (starting from the second step 112*b*) of the staircase 110. In one embodiment of the present disclosure, a pair of nozzles 132 are provided for each step 112, both of which are configured to generate water spray substantially towards a middle of the top surface 118 of the step 112 beneath therefrom. For this purpose, the nozzles 132 may be positioned so as to downwardly direct the water spray towards the top surface 118 of the target step 112. In some examples, the nozzles 132 may be provided with swivel fittings (not shown) which allows for changing the angle of the nozzles 132 as per liking. Therefore, as seen from FIG. 1, the nozzles 132*a* are secured to the bottom surface of the step 112*b* at the extended space 124 and are aligned to direct the water spray towards the middle of the step 112*a* in the pool ladder 100. In one embodiment, each of the nozzles 132 may be provided with valves (not shown) which controls the flow of water therefrom, that is the valve may be switched to open or closed positions in order to turn on or off the flow of water from the corresponding nozzle 132, respectively.

Further, as may be seen from FIGS. 1-2, the sensors 134 may be located towards one of the side edges of each of the steps 112. In one example, the sensors 134 may be secured to one of the vertical wall 114 in relation to each of the steps 112. In one embodiment, the sensors 134 may be any motion or proximity detection sensors, which are well known in the art. In alternate examples, the wash-down system 130 may use pressure sensors placed below each of the steps 112, and which detect the presence of a person standing on the corresponding step by detecting increase in weight thereon. Specifically, in the present example, the employed sensors 134 are photoelectric sensors, such as infrared sensors which detect motion around its surroundings by emitting infrared radiation and then detecting reflected radiation off from a person's body. In the present example, the sensor 134*a* may generate a signal when a person is standing on the step 112*a* corresponding thereto, the sensor 134*b* may generate a signal when a person is standing on the step 112*b* corresponding thereto, and so on.

Further, in the wash-down system 130, the controller 136 may be located at any suitable position with respect to the staircase 110. In the example of FIG. 2, the controller 136 has been shown to be positioned underneath the staircase 110 between the vertical walls 114 which makes the assembly tidy; however, in alternate examples, the controller 136 may be located outside the staircase 110 without any limitations. The controller 136 is disposed in signal communication with each of the sensors 134 to receive the signal generated on detecting presence of a person on a corresponding step 112. Further, the controller 136 is in signal communication with the valves associated with each of the nozzles 132 of the wash-down system 130. It may be contemplated by a person skilled in the art that the controller 136 is disposed in communication with the nozzles 132 by means of electrical connections 138*a*, and with the sensors 134 by means of electrical connections 138*b*. These electrical connections 138*a*, 138*b* may be routed within the staircase 110 in consideration of the space constrains therein, but have only been shown schematically by dashed lines in FIG. 2 for illustration purposes. The controller 136, as described herein, may be any processor-based or microprocessor-based system including systems using microcontrollers, reduced instruction set computers (RISC), application specific integrated circuits (ASICs), field-programmable gate arrays (FPGAs), graphical processing units (GPUs), logic circuits, and any other circuit capable of executing the functions required by the wash-down system 130.

As may be understood, the wash-down system 130 may further include connection to a water tank or the like (not shown) to supply water to the nozzles 132. In alternate examples, the wash-down system 130 may include a local water tank secured to the staircase 110 and filled with water or some other fluid, and further connected, via pipes, to the nozzles 132 to supply water thereto. In an example, the fluid in the local water tank may be mixed with a washing agent, such as soap or the like for more aggressive cleaning of the person's feet standing on any of the step of the pool ladder 100. In other examples, the wash-down system 130 may include a pump 140 (as exemplarily shown in FIG. 2) which may be able to pull water from the swimming pool itself or some other water source, such as an overhead tank, via an inlet pipe 142 (when needed) and supply the water to the nozzles 132 via pipe connections 144. The pump 140, thereby, avoids the need of a separate water storage tank, while further aid in generating enough pressure through the nozzles to properly clean the person's feet climbing the pump 140 may be regulated by the controller 136, via electric connection 138*c*, to switch ON or OFF as per whether the flow of water is required or not, respectively.

Further, in an embodiment, the nozzles 132 may be attached to the staircase 110 in relatively flexible manner. For this purpose, in one example, the nozzles 132 may be attached to the bottom surface 120 of the steps 112 by means of a resilient member, such as a corrugated pipe or the like. This allows for changing the alignment of the nozzles 132 in order to change the angle of water spray therefrom. This may be required to compensate for the pressure of the flow of water from the associated water source, for example, when the pressure of flow of water is low, the nozzles 132 may be aligned to be closer to the middle of the steps 112 and vice-versa. Further, it may also help to fine tune the water spray to customize for a particular family need, if desired.

The working of the wash-down system 130 of the present disclosure is described in the detail herein. In the wash-down system 130 of the pool ladder 100, when a person is standing on the step 112*a*, the sensor 134*a* detects such presence and send the signal to the controller 136, which sends a corresponding signal to open the valve associated with the nozzles 132*a* to turn those on, and thereby generating sprays of water directed towards the top surface 118 of the step 112*a* for washing the person's feet standing thereon. As the person climbs to the step 112*b*, the sensor 134*a* detects the absence of the person on the step 112*a* and thus the controller 136 may stop the water spray on the step 112*a*. Simultaneously, the sensor 134*b* detects the presence of person on the step 112*b*, and in a similar manner the corresponding nozzles 132*b* are turned on to generate water spray towards the step 112*b*. The process may be repeated as the person climb to step 112*c* and so on, in the pool ladder 100. In some examples, the controller 136 may restrict the flow of water through one set of nozzles 132 for a limited time, for example in case when a person may be standing on a step 112 for more than enough time required for cleaning a person's feet.

Further, in one embodiment, the controller 136 may be programmed to only start the flow of water when the person may be climbing up the staircase 110 and not moving downwards thereon. For this purpose, the controller 136 may identify the first signal received from the sensors 134, and determine if this first signal is from the sensor 134*a* or 134*d* (as in the present example). The controller 136 may only start the flow of water to the nozzles 132 when the first signal is from the sensor 134*a*, and does not allow the flow of water to the nozzles 132 when the first signal is from the sensor 134*d*. It may be understood that this may been done as a person coming out of the swimming pool to climb down the staircase 110 may not need washing of the feet. Thus, such programming of the controller 136 may, in turn, help to conserve the supply of water in the wash-down system 130.

In one embodiment of the present disclosure, the pool ladder 100 may include solar panels (not shown) attached at some suitable location, such as, for example, at an upper end of the handrail 126. Such solar panels may generate sufficient electricity to power the components of the automatic wash-down system 130 of the present disclosure, in particular, the digital controller 136 and the electric valves associated with the nozzles 132 for regulating the flow of water therein. This could possibly make the pool ladder 100 a standalone assembly which may not require any additional power source to operate the components therein for achieving its objectives.

Further, in some examples, the staircase 110 may include drain channels (not shown) which allows for the collected water (after cleaning) to be removed. For this purpose, the steps 112 may be slightly sloped to direct the collected water to such drain channels. In some examples, the vertical walls 114 may have slots or apertures formed therein to allow for the water to flow outwards from inside of the pool ladder 100, in order to avoid algae growth therein. It may be understood that, in some examples, the nozzles 132 may simply be apertures formed in the appropriate locations of the staircase 110 with water supply connections. Further, in one example, the wash-down system 130 may only use one sensor and one nozzle located at any one of the steps for cleaning purpose, without any limitations. In yet another example, the operation of the nozzles may be manually controlled. It may be understood that any reference to person's feet above may also include other parts of person's body, particularly lower portion of legs which also may have dirt or debris stuck thereto.

Figure 3:
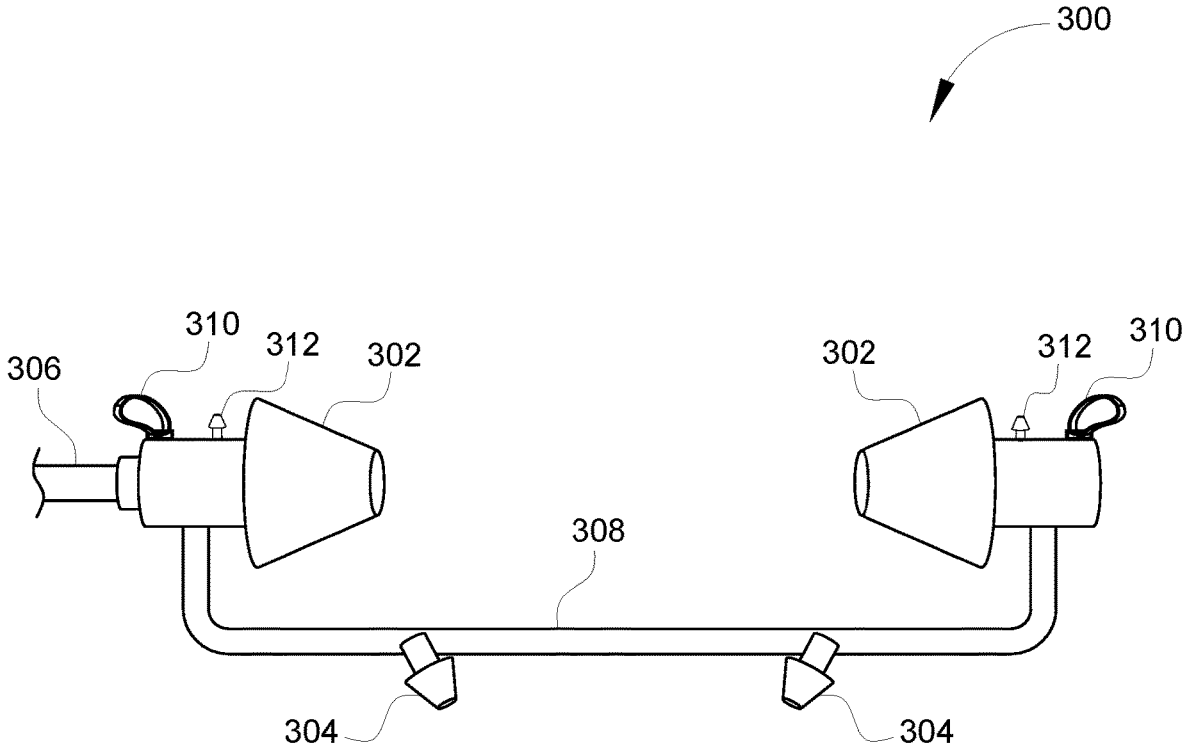
FIG. 3 illustrates a diagrammatic view of a wash-down system, in accordance with another embodiment of the present disclosure.
Figure 4:
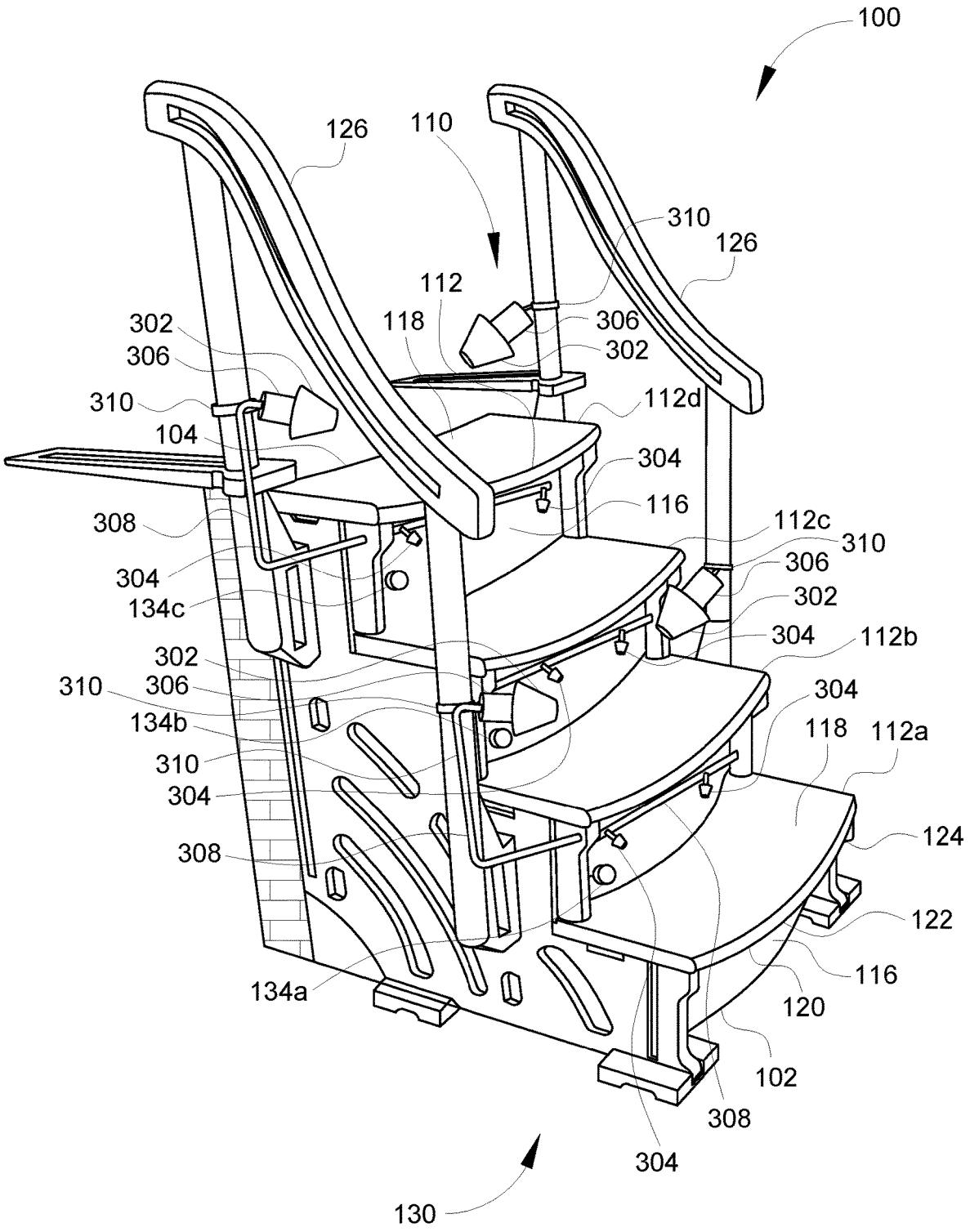
FIG. 4 illustrates a perspective view of the pool ladder with the wash-down system of FIG. 3, in accordance with another embodiment of the present disclosure.

FIG. 3 illustrates an alternate wash-down system 300, in accordance with another embodiment of the present disclosure. The alternate wash-down system 300, similar to the wash-down system 130 as described earlier, is designed to be installed with the pool ladder 100. FIG. 4 illustrates an exemplary embodiment in which the alternate wash-down system 300 is installed with the pool ladder 100. The alternate wash-down system 300 includes a first set of nozzles 302 which may be generally arranged on side of the steps 112 of the pool ladder 100. Further, the alternate wash-down system 300 includes a second set of nozzles 304 which may be generally arranged around the extended surface 124, and specifically secured to the bottom surface 120 of each step 112 (similar to the nozzles 132). In such arrangement, the first set of nozzles 302 may be configured to provide water spray towards middle of the step 112 so as to wash sides of the feet of the person climbing into the swimming pool using the pool ladder 100. Further, the second set of nozzles 304 may be configured to provide water spray downwards to the step below the corresponding step 112 so as to wash top of the feet of the person climbing into the swimming pool using the pool ladder 100. In some examples, the first set of nozzles 302 may be pivotally arranged in order to allow adjusting the direction of water sprayed therefrom.

As better illustrated in FIG. 3, a water hose 306 may be connected to one of the first set of nozzles 302 and further that nozzle may be in fluid communication with other nozzle of the first set of nozzles 302, as well as the second set of nozzles 304 via a pipe 308. This way the water hose 306 (generally represented in FIG. 4) may provide the water to the first set of nozzles 302 as well as the second set of nozzles 304 (via the pipe 308) for operation. It may be understood that the water hose 306 may be connected to the water tank (as discussed before) for receiving supply of the water. Further, it will be appreciated that the controller (such as, the controller 136) can be implemented to control the flow of water through the nozzles 302 and 304 based on the signals from sensors (such as, the sensors 134), as discussed in the preceding paragraphs. In the present embodiment, as illustrated in FIGS. 3-4, the first set of nozzles 304 may be provided with a set of loops 310 which may be coupled with vertical member of the handrail 126 (laterally arranged with respect to the steps 112) for supporting and mounting the alternate wash-down system 300 with the pool ladder 100 (as illustrated in FIG. 4). In some examples, as illustrated in FIG. 3, the first set of nozzles 302 may be provided with control means 312 to regulate the flow of water from the nozzles 302 therein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pool ladder to allow a person to climb and enter into an above-ground swimming pool, the pool ladder comprising:

a staircase having a series of steps spaced vertically and horizontally offset from one another; and a wash-down system for cleaning a person's feet climbing up the staircase, the wash-down system comprising:

one or more nozzles arranged with each of the steps in the staircase, wherein the one or more nozzles are configured to generate flow of water;

one or more sensors configured to detect presence of a person climbing up the staircase; and a controller disposed in signal communication with the one or more sensors to receive signals indicating the presence of a person and selectively control the one or more nozzles to generate the flow of water upon receipt of the signal from the one or more sensors, the controller is programmed to only initiate the flow of water when the person is climbing up the staircase and not moving downwards thereon.

2. The pool ladder of claim 1, wherein the steps have a top surface and an opposing bottom surface, and wherein the nozzles are secured to a bottom surface of each step, and wherein the nozzles are configured to generate water spray substantially towards a middle of a top surface of the step beneath thereto.

3. The pool ladder of claim 2, wherein each of the steps have non-slip treads provided on the top surface thereof.

4. The pool ladder of claim 1, wherein the steps are spaced apart and connected to each other by vertical risers.

5. The pool ladder of claim 1, further comprising a pair of generally planar parallel vertical walls defining sides of the staircase.

6. The pool ladder of claim 1, further comprising a handrail extending parallel to a slope of the steps.

7. The pool ladder of claim 1, wherein each of the steps have a front portion with a curved profile to provides safe access for a person climbing thereon.

8. The pool ladder of claim 1, wherein the one or more nozzles comprise a pair of nozzles provided for each step.

9. The pool ladder of claim 1, wherein the nozzles are pivotally arranged to allow for changing angles of flow of water therefrom.

10. The pool ladder of claim 1, wherein the nozzles are provided with valves to control the flow of water therefrom.

11. The pool ladder of claim 1 further comprising a pump configured to pull water from a water source and supply the water to the nozzles to generate flow of water therefrom.

12. The pool ladder of claim 11, wherein the controller is configured to activate the pump upon receipt of the signal from the one or more sensors.

13. The pool ladder of claim 1, wherein the one or more sensors include one of motion sensors and proximity sensors.

14. The pool ladder of claim 1, wherein the staircase is made of molded plastic materials.

* * * * *